US012486611B2

(12) United States Patent
Leibman et al.

(10) Patent No.: US 12,486,611 B2
(45) Date of Patent: Dec. 2, 2025

(54) DRYER APPLIANCE AND DISPENSING SYSTEM

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Robert Byron, Louisville, KY (US); Jay Pareshbhai Shinde, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 797 days.

(21) Appl. No.: 17/713,560

(22) Filed: Apr. 5, 2022

(65) Prior Publication Data

US 2023/0313438 A1 Oct. 5, 2023

(51) Int. Cl.

| | |
|---|---|
| ***D06F 39/08*** | (2006.01) |
| ***B05B 1/30*** | (2006.01) |
| ***D06F 58/20*** | (2006.01) |
| ***D06F 58/32*** | (2020.01) |

(52) U.S. Cl.
CPC ..... *D06F 58/203* (2013.01)

(58) Field of Classification Search
CPC ..... B05B 1/3073; B05B 1/32; D06F 39/088; D06F 58/203; D06F 58/32
See application file for complete search history.

(56) References Cited

U.S. PATENT DOCUMENTS

| | | | | |
|---|---|---|---|---|
| 5,063,619 | A * | 11/1991 | Ross | E03D 9/08 4/443 |
| 7,228,994 | B2 | 6/2007 | Noyes et al. | |
| 8,234,887 | B2 | 8/2012 | Ahn | |
| 8,256,136 | B2 | 9/2012 | Bae et al. | |
| 8,819,959 | B2 | 9/2014 | Klug et al. | |
| 8,850,856 | B2 | 10/2014 | Leibman et al. | |
| 9,217,219 | B2 | 12/2015 | Hanau et al. | |
| 9,493,901 | B2 | 11/2016 | Bolduan et al. | |
| 10,294,604 | B2 * | 5/2019 | Leibman | D06F 60/00 |
| 10,633,782 | B2 | 4/2020 | Leibman | |
| 10,876,245 | B2 | 12/2020 | Channal et al. | |
| 11,001,953 | B2 * | 5/2021 | Kim | D06F 37/06 |
| 2014/0352364 | A1 | 12/2014 | Martinez Villarreal | |
| 2014/0373284 | A1 | 12/2014 | Leidman et al. | |
| 2018/0371679 | A1 | 12/2018 | Leibman | |

FOREIGN PATENT DOCUMENTS

| | | | |
|---|---|---|---|
| CN | 112853687 | A | 5/2021 |

* cited by examiner

*Primary Examiner* — Deming Wan
(74) *Attorney, Agent, or Firm* — Dority & Manning, P.A.

(57) ABSTRACT

A laundry appliance including a cabinet and a flow control device is provided. The cabinet includes a drum rotatably mounted within the cabinet. The drum defines a chamber for receipt of articles for drying. The flow control device includes a body forming a plurality of inlet openings. The body forms a flowpath from each inlet opening to an outlet opening. The plurality of inlet openings is each configured to receive a fluid. The body is in fluid communication with the chamber through the outlet opening to provide a fluid received through one or more of the plurality of inlet openings. The flow control device includes a valve positioned at the flowpath.

11 Claims, 7 Drawing Sheets

DRYER APPLIANCE AND DISPENSING SYSTEM

FIELD OF THE INVENTION

The present subject matter relates generally to dryer appliances, or more specifically, to flow control devices for providing multiple fluids to an appliance.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a system for passing dry, heated air through the chamber in order to dry moisture-laden articles positioned therein. Typically, an air handler or blower is used to urge the flow of heated air through the chamber to dry the clothes.

Certain dryer appliance configurations may include a steam function and other post-dry functions requiring a plurality of fluids provided to the chamber. Various fittings may be utilized to provide fluid communication. However, the addition of such fittings may require forming new openings at the cabinet, a plurality of fittings, or other structures that increase cost and complexity of including steam functions and post-dry functions to a dryer appliance.

Accordingly, a dryer appliance with features providing fluid communication to a chamber is desired. More particularly, structures providing fluid communication of multiple fluids at an appliance is desired.

BRIEF DESCRIPTION OF THE INVENTION

Advantages of the invention will be set forth in part in the following description, or may be apparent from the description, or may be learned through practice of the invention.

In one exemplary embodiment, a laundry appliance including a cabinet and a flow control device is provided. The cabinet includes a drum rotatably mounted within the cabinet. The drum defines a chamber for receipt of articles for drying. The flow control device includes a body forming a plurality of inlet openings. The body forms a flowpath from each inlet opening to an outlet opening. The plurality of inlet openings is each configured to receive a fluid. The body is in fluid communication with the chamber through the outlet opening to provide a fluid received through one or more of the plurality of inlet openings. The flow control device includes a valve positioned at the flowpath.

In another exemplary embodiment, a dryer appliance including a cabinet, a drum, a conditioning system, a post-dry system, and a flow control device is provided. The drum is rotatably mounted within the cabinet and defines a chamber for receipt of articles for drying. The conditioning system is in fluid communication with the chamber and is configured to heat and remove moisture from air flowing therethrough. The post-dry system includes a reservoir containing a fluid solution. The flow control device includes a body forming a first inlet opening at a first inlet flowpath and a second inlet opening at a second inlet flowpath. The first inlet flowpath is in fluid communication with a first supply conduit to receive water or water vapor through the first inlet opening. The second inlet flowpath is in fluid communication with a second supply conduit to receive a fluid solution through the second inlet opening from the reservoir. The body forms an outlet flowpath in fluid communication with the first inlet flowpath and the second inlet flowpath. An outlet conduit provides fluid communication with the outlet flowpath through an outlet opening formed at the outlet flowpath. A valve is at the first inlet flowpath and the second inlet flowpath and is configured to selectively provide fluid communication from the first inlet flowpath and the second inlet flowpath to the outlet flowpath.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
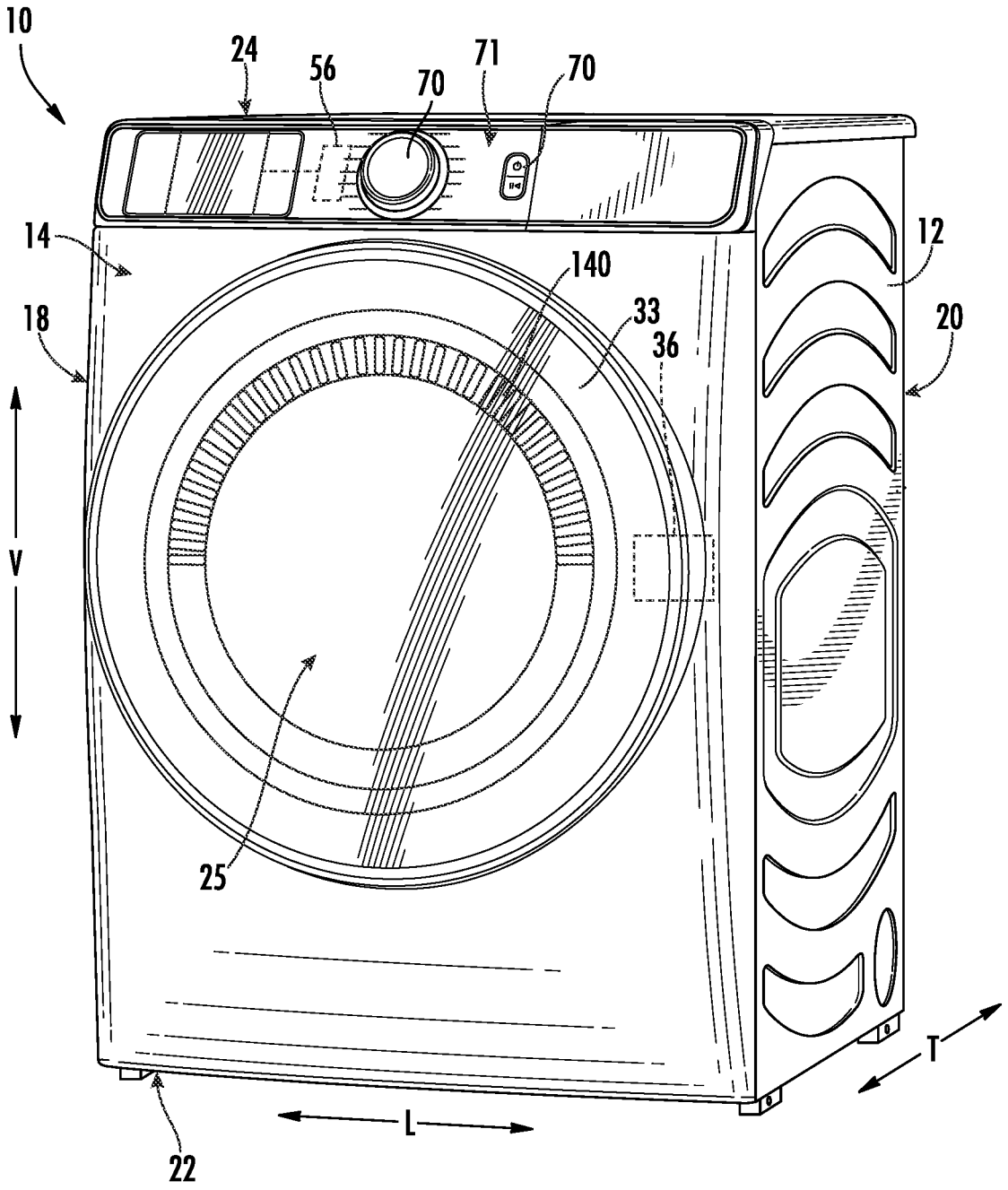
FIG. 1 provides a perspective view of a dryer appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Embodiments a laundry appliance and a flow control device are provided. The flow control device includes a plurality of inlet flowpaths at which a valve is positioned at the inlet flowpath. The plurality of inlet flowpaths is in fluid communication with an outlet flowpath. The plurality of inlet flowpaths is configured to receive two or more fluids therethrough. For instance, a first inlet flowpath receives water or water vapor and a second inlet flowpath receives a fluid solution, such as a scented solution or other desired solution, such as may be desired after a drying cycle has been completed at a dryer appliance. The valve is configured to prevent backflow of the respective fluids through the inlet flowpath, and to promote flow through the outlet flowpath. The outlet flowpath may particularly be a single outlet flowpath, such that a single opening is formed through the appliance to fluidly connect the flow control device to a desired structure, such as a chamber at which the water, water vapor, and fluid solution may be provided to articles at the chamber.

The flow control device may include any appropriate type of compression fitting or quick connect fitting, such as, but not limited to, a push-to-pull fitting, a push-to-connect fitting, a push-in fitting, a push-fit fitting, or an instant fitting. The valve may be formed or built into the compression fitting. The body may form a unitary, monolithic, integral structure at which the valve including the compression fitting is connectable. A fluid conduit, such as a hose, is connectable, such as by threading, at respective inlet openings and the outlet opening at the flow control device.

Embodiments of the flow control device provided herein may be included with an appliance, such as a dyer appliance. The flow control device may allow multiple fluid inputs to be provided through a single output, allowing for reduced cost and complexity, or for facilitating installation of additional of fluid systems that may receive fluid from one or more reservoirs.

Figure 2:
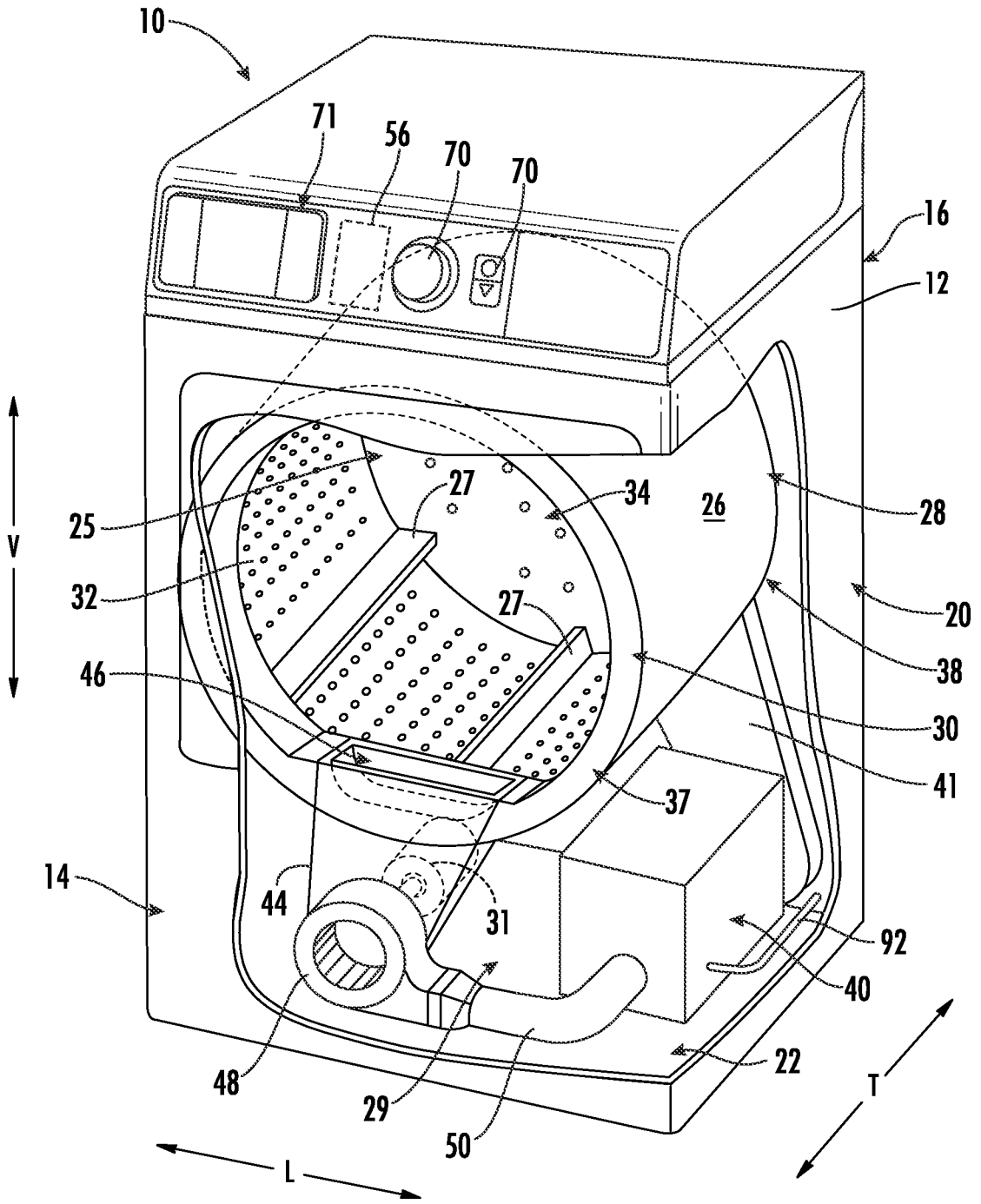
FIG. 2 provides a perspective view of the example dryer appliance of FIG. 1 with portions of a cabinet of the dryer appliance removed to reveal certain components of the dryer appliance.

Referring now to the figures, an exemplary laundry appliance that may be used to implement aspects of the present subject matter will be described. Specifically, FIGS. 1 and 2 provide perspective views of a dryer appliance 10 according to exemplary embodiments of the present disclosure. Particularly, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance, a condenser dryer, or any other suitable laundry appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A drum or container 26 is mounted for rotation about a substantially horizontal axis within the interior volume 29 of cabinet 12. Drum 26 defines a chamber 25 for receipt of articles for tumbling and/or drying. Drum 26 extends between a front portion 37 and a back portion 38, e.g., along the transverse direction T. Drum 26 also includes a back or rear wall 34, e.g., at back portion 38 of drum 26. A supply duct 41 may be mounted to rear wall 34. Supply duct 41 receives heated air that has been heated by a conditioning system 40 and provides the heated air to drum 26 via one or more holes defined by rear wall 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of holes that receive hot air that has been heated by a conditioning system 40. The conditioning system 40 may include a heat pump or refrigerant-based conditioning system. Moisture laden, heated air is drawn from drum 26 by an air handler, such as a blower fan 48, which generates a negative air pressure within drum 26.

As shown, dryer appliance 10 may further include one or more lint filters 46 (FIG. 2) to collect lint during drying operations. The moisture laden heated air passes through a duct 44 enclosing screen filter 46, which traps lint particles. More specifically, filter 46 may be placed into a process airflow path 58 of air flow through appliance 10 and include a screen, mesh, other material to capture lint in the air flow. The location of lint filters in appliance 10 as shown in FIG. 2 is provided by way of example only, and other locations may be used as well. As shown, lint filter 46 is readily accessible by a user of the appliance. As such, lint filter 46 should be manually cleaned by removal of the filter, pulling or wiping away accumulated lint, and then replacing the filter 46 for subsequent drying cycles.

As the air passes from blower fan 48, it enters a duct 50 and then is passed into conditioning system 40. In some embodiments, the conditioning system 40 may be or include an electric heating element, e.g., a resistive heating element, or a gas-powered heating element, e.g., a gas burner. According to the illustrated exemplary embodiment, dryer appliance 10 is a heat pump dryer appliance and thus conditioning system 40 may be or include a heat pump including a sealed refrigerant circuit, as described in more detail below with reference to FIG. 3. Heated air (with a lower moisture content than was received from drum 26), exits conditioning system 40 and returns to drum 26 by duct 41. After the clothing articles have been dried, they are removed from the drum 26 via opening 32. However, other embodiments of the dryer appliance 10 may be configured as open loop airflow appliances that are fluidly coupled to an exhaust duct where the heated air is exhausted from the dryer appliance.

A door 33 provides for closing or accessing drum 26 through opening 32. According to exemplary embodiments, a window (not shown) in door 33 permits viewing of chamber 25 when door 33 is in the closed position, e.g., during operation of dryer appliance 10. Door 33 also includes a handle that, e.g., a user may pull when opening and closing door 33. Further, although door 33 is illustrated as mounted to front panel 14, it should be appreciated that door 33 may be mounted to another side of cabinet 12 or any other suitable support according to alternative embodiments. Dryer appliance 10 may further include a latch assembly 36 (see FIG. 1) that is mounted to cabinet 12 and/or door 33 for selectively locking door 33 in the closed position. Latch assembly 36 may be desirable, for example, to ensure only secured access to chamber 25 or to otherwise ensure and verify that door 33 is closed during certain operating cycles or events.

In some embodiments, one or more selector inputs 70, such as knobs, buttons, touchscreen interfaces, etc., may be provided or mounted on a cabinet 12 (e.g., on a user interface panel 71) and are communicatively coupled with (e.g., electrically coupled or coupled through a wireless network band) a processing device or controller 56. Controller 56 may also be communicatively coupled with various operational components of dryer appliance 10, such as motor 31, blower 48, and/or components of conditioning system 40. In turn, signals generated in controller 56 direct operation of motor 31, blower 48, or conditioning system 40 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56.

Figure 3:
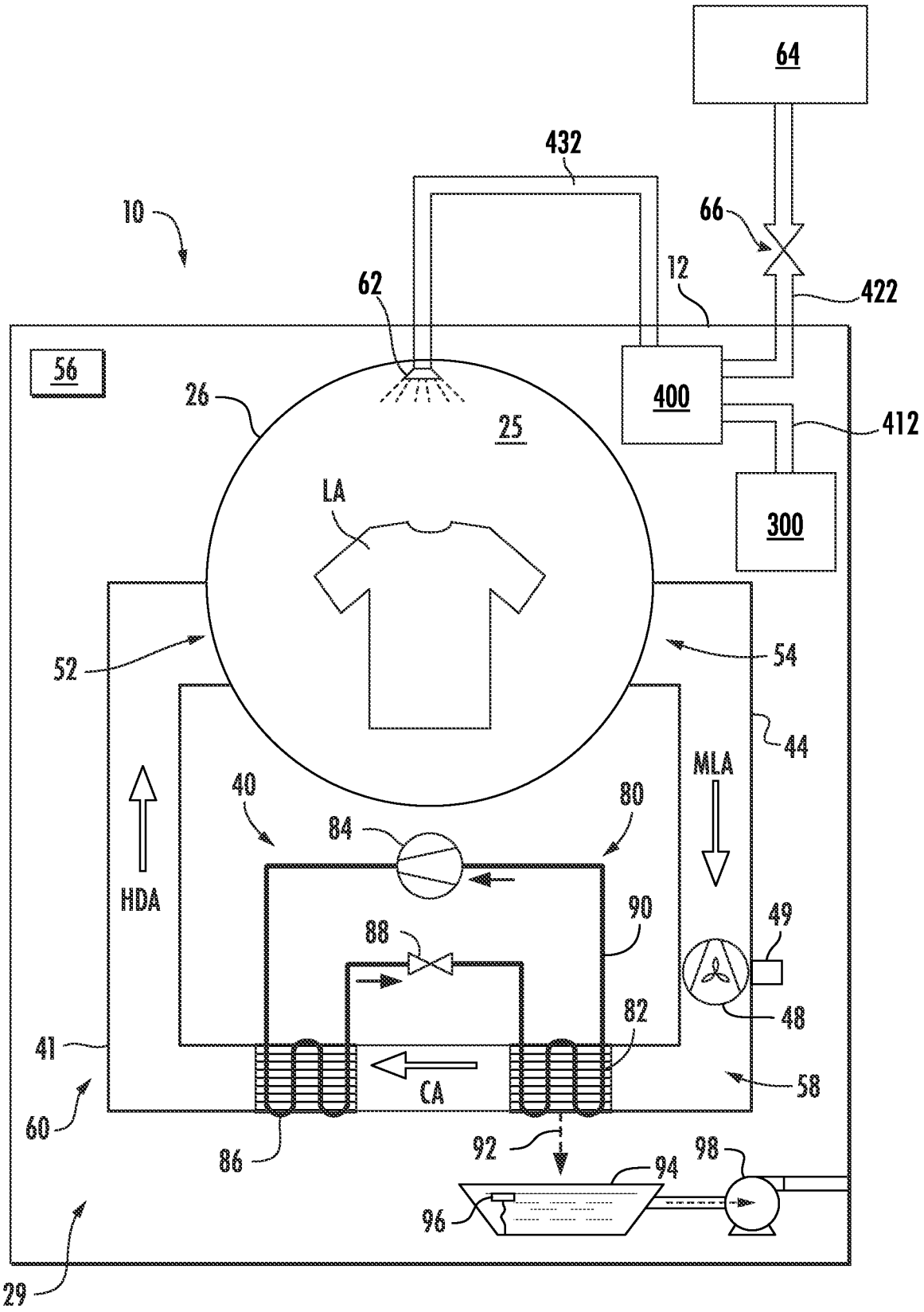
FIG. 3 provides a schematic diagram of an exemplary dryer appliance including a flow control device in accordance with exemplary embodiments of the present disclosure.

FIG. 3 provides an exemplary schematic view a dryer appliance 10 and depicts conditioning system 40 in more detail. For this embodiment, dryer appliance 10 is a heat pump dryer appliance and thus conditioning system 40 includes a sealed system 80. Sealed system 80 includes various operational components, which can be encased or located within a machinery compartment of dryer appliance 10. Generally, the operational components are operable to execute a vapor compression cycle for heating process air passing through conditioning system 40. The operational components of sealed system 80 include an evaporator 82, a compressor 84, a condenser 86, and one or more expansion devices 88 connected in series along a refrigerant circuit or line 90. Refrigerant line 90 is charged with a working fluid, which in this example is a refrigerant. Sealed system 80 depicted in FIG. 3 is provided by way of example only. Thus, it is within the scope of the present subject matter for other configurations of the sealed system to be used as well. As will be understood by those skilled in the art, sealed system 80 may include additional components, e.g., at least one additional evaporator, compressor, expansion device, and/or condenser. As an example, sealed system 80 may include two (2) evaporators.

In performing a drying and/or tumbling cycle, one or more laundry articles LA may be placed within the chamber 25 of drum 26. Hot dry air HDA is supplied to chamber 25 via duct 41. The hot dry air HDA enters chamber 25 of drum 26 via a drum inlet 52 defined by drum 26, e.g., the plurality of holes defined in rear wall 34 of drum 26 as shown in FIG. 2. The hot dry air HDA provided to chamber 25 causes moisture within laundry articles LA to evaporate. Accordingly, the air within chamber 25 increases in water content and exits chamber 25 as warm moisture laden air MLA. The warm moisture laden air MLA exits chamber 25 through a drum outlet 54 defined by drum 26 and flows into duct 44.

After exiting chamber 25 of drum 26, the warm moisture laden air MLA flows downstream to conditioning system 40. Blower fan 48 moves the warm moisture laden air MLA, as well as the air more generally, through a process air flowpath 58 defined by drum 26, conditioning system 40, and the primary duct system 60. Thus, generally, blower fan 48 is operable to move air through or along the process air flowpath 58. Primary duct system 60 includes all ducts that provide fluid communication (e.g., airflow communication) between drum outlet 54 and conditioning system 40 and between conditioning system 40 and drum inlet 52. Although blower fan 48 is shown positioned between drum 26 and conditioning system 40 along duct 44, it will be appreciated that blower fan 48 can be positioned in other suitable positions or locations along primary duct system 60.

As further depicted in FIG. 3, the warm moisture laden air MLA flows into or across evaporator 82 of the conditioning system 40. As the moisture-laden air MLA passes across evaporator 82, the temperature of the air is reduced through heat exchange with refrigerant that is vaporized within, for example, coils or tubing of evaporator 82. This vaporization process absorbs both the sensible and the latent heat from the moisture-laden air MLA—thereby reducing its temperature. As a result, moisture in the air is condensed and such condensate water may be drained from conditioning system 40, e.g., using a drain line 92, which is also depicted in FIG. 2.

For this embodiment, a condenser tank or a condensate collection tank 94 is in fluid communication with conditioning system 40, e.g., via drain line 92. Collection tank 94 is operable to receive condensate water from the process air flowing through conditioning system 40, and more particularly, condensate water from evaporator 82. A sensor 96 operable to detect when water within collection tank 94 has reached a predetermined level. Sensor 96 can be any suitable type of sensor, such as a float switch as shown in FIG. 3. Sensor 96 can be communicatively coupled with controller 56, e.g., via a suitable wired or wireless communication link, and may be used to determine when condensate collection tank 94 needs to be drained.

A drain pump 98 is in fluid communication with collection tank 94. Drain pump 98 is operable to remove a volume of water from collection tank 94 and, for example, discharge the collected condensate to an external drain (e.g., to an external drain used by an associated washing machine appliance within the same environment). In some embodiments, drain pump 98 can remove a known or predetermined volume of water from collection tank 94. Drain pump 98 can remove the condensate water from collection tank 94 and can move or drain the condensate water downstream, e.g., to a gray water collection system. Particularly, in some embodiments, controller 56 is configured to receive, from sensor 96, an input indicating that water within the collection tank has reached the predetermined level. In response to the input indicating that water within collection tank 94 has reached the predetermined level, controller 56 can cause drain pump 98 to remove the predetermined volume of water from collection tank 94.

Air passing over evaporator 82 becomes cooler than when it exited drum 26 at drum outlet 54. As shown in FIG. 3, cool air CA (cool relative to hot dry air HDA and moisture laden air MLA) flowing downstream of evaporator 82 is subsequently caused to flow across condenser 86, e.g., across coils or tubing thereof, which condenses refrigerant therein. The refrigerant enters condenser 86 in a gaseous state at a relatively high temperature compared to the cool air CA from evaporator 82. As a result, heat energy is transferred to the cool air CA at the condenser 86, thereby elevating its temperature and providing warm dry air HDA for resupply to drum 26 of dryer appliance 10. The warm dry air HDA passes over and around laundry articles LA within the chamber 25 of the drum 26, such that warm moisture laden air MLA is generated, as mentioned above. Because the air is recycled through drum 26 and conditioning system 40, dryer appliance 10 can have a much greater efficiency than traditional clothes dryers can where all of the warm, moisture-laden air MLA is exhausted to the environment.

With respect to sealed system 80, compressor 84 pressurizes refrigerant (i.e., increases the pressure of the refrigerant) passing therethrough and generally motivates refrigerant through the sealed refrigerant circuit or refrigerant line 90 of conditioning system 40. Compressor 84 may be communicatively coupled with controller 56 (communication lines not shown in FIG. 3). Refrigerant is supplied from the evaporator 82 to compressor 84 in a low pressure gas phase. The pressurization of the refrigerant within compressor 84 increases the temperature of the refrigerant. The compressed refrigerant is fed from compressor 84 to condenser 86 through refrigerant line 90. As the relatively cool air CA from evaporator 82 flows across condenser 86, the refrigerant is cooled and its temperature is lowered as heat is transferred to the air for supply to chamber 25 of drum 26.

Upon exiting condenser 86, the refrigerant is fed through refrigerant line 90 to expansion device 88. Although only one expansion device 88 is shown, such is by way of example only. It is understood that multiple such devices may be used. In the illustrated example, expansion device 88 is an electronic expansion valve, although a thermal expansion valve or any other suitable expansion device can be used. In additional embodiments, any other suitable expansion device, such as a capillary tube, may be used as well. Expansion device 88 lowers the pressure of the refrigerant and controls the amount of refrigerant that is allowed to enter the evaporator 82. Importantly, the flow of liquid refrigerant into evaporator 82 is limited by expansion device 88 in order to keep the pressure low and allow expansion of the refrigerant back into the gas phase in evaporator 82. The evaporation of the refrigerant in evaporator 82 converts the refrigerant from its liquid-dominated phase to a gas phase while cooling and drying the moisture laden air MLA received from chamber 25 of drum 26. The process is repeated as air is circulated along process air flowpath 58 while the refrigerant is cycled through sealed system 80, as described above.

Although dryer appliance 10 is depicted and described herein as a heat pump dryer appliance, the inventive aspects of the present disclosure can apply to other types of dryer appliances, including other closed loop configurations and open loop configurations. For instance, in other embodiments, dryer appliance 10 can be a condenser dryer that utilizes an air-to-air heat exchanger instead of evaporator 82 and/or an electric heater may be provided instead of condenser 86. Thus, in such embodiments, the working fluid that interacts thermally with the process air may be air. In yet other embodiments, dryer appliance 10 can be a spray tower dryer appliance that utilizes a water-to-air heat exchanger instead of utilizing a sealed refrigerant. Thus, in such embodiments, the working fluid that interacts thermally with the process air may be water. Further, in some embodiments, dryer appliance 10 can be a combination washer/dryer appliance having a closed loop airflow circuit along which process air may flow for drying operations. In still other embodiments, the dryer appliance 10 can be an open loop configuration in which air is pulled into the dryer appliance 10 and heated and utilized to dry the laundry articles before being exhausted, such as to an ambient environment outside of the dryer appliance 10.

According to exemplary embodiments, dryer appliance 10 may facilitate a steam dry process. In this regard, dryer appliance 10 may offer a steam drying cycle, during which steam is injected into chamber 25, e.g., to function similar to a traditional garment steamer to help remove wrinkles, static, etc. Accordingly, as shown for example in FIG. 3, dryer appliance 10 may include a misting nozzle 62 that is in fluid communication with a water supply 64 in order to direct mist into chamber 25. Dryer appliance 10 may further include a water supply valve or control valve 66 for selecting discharging the flow of mist into chamber 25. It should be appreciated that control valve 66 may be positioned at any other suitable location within cabinet 12.

The dryer appliance 10 may include one or more post-dry systems 300 configured to provide a fluid solution to the chamber 25. The fluid solution may be a water-based solution. In certain embodiments, the fluid solution is a scent, cleaning product, or a fluid generally appropriate for application to laundry articles after a drying cycle. In various embodiments, the post dry system 300 includes a pump 310 configured to flow the fluid solution from a reservoir 320 to a flow control device 400. A reservoir conduit 322 provides fluid communication of the fluid solution from the reservoir 320 to the pump 310. In various embodiments, the reservoir 320 is positioned within the cabinet 12. The reservoir 320 is configured to store the fluid solution. A fluid supply conduit 412, such as further described herein, is fluidly coupled to the reservoir 320. The pump 310 is configured to selectively flow the fluid solution from the reservoir 320 through the fluid supply conduit 412 and through a flow control device 400. The pump 310 flows the fluid solution from the reservoir 320 through one or more of a plurality of inlet openings 410 and through an outlet opening 430 of a flow control device 400.

Figure 4B:
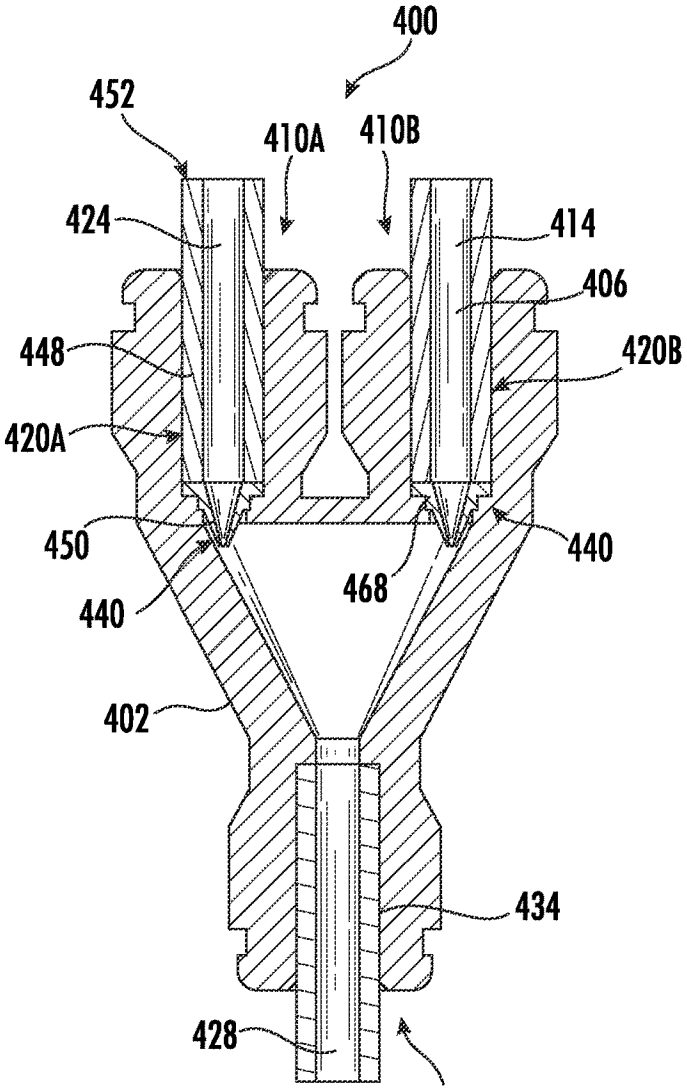
FIG. 4B provides an internal view of the flow control device of FIG. 4A in accordance with exemplary embodiments of the present disclosure.
Figure 4A:
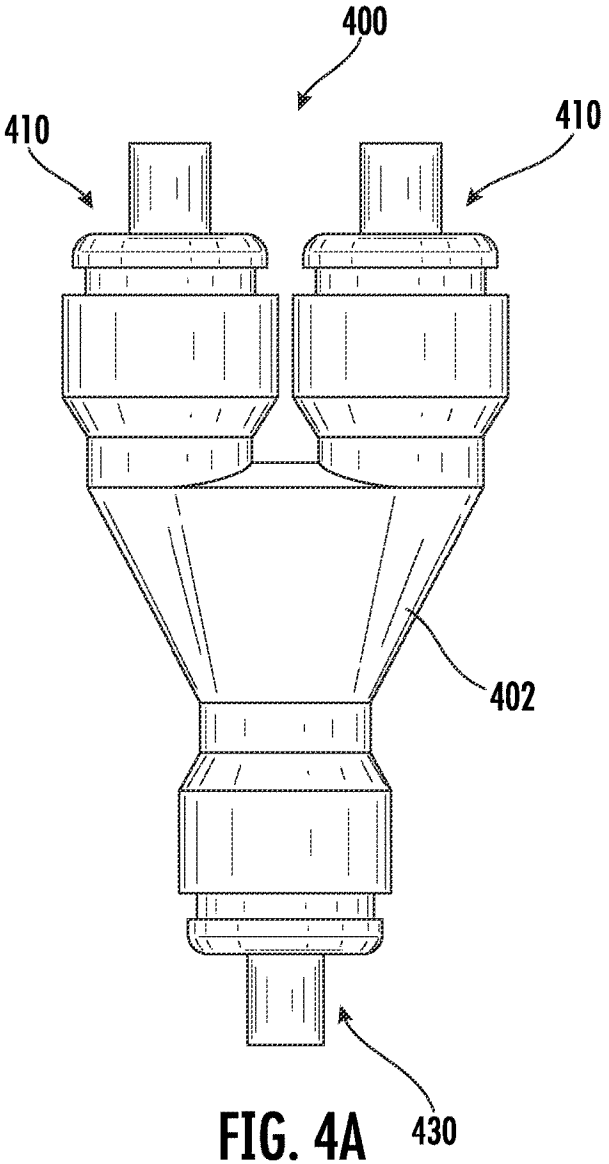
FIG. 4A provides an external view of a flow control device in accordance with exemplary embodiments of the present disclosure.

Referring to FIGS. 4A-4B, an embodiment of a flow control device 400 in accordance with aspects of the present disclosure is provided. The flow control device 400 includes a body 402 forming a plurality of inlet openings 410. The body 402 forms a flowpath 420 from each inlet opening 410 to an outlet opening 430. The plurality of inlet openings 410 is each configured to receive a fluid, such as described herein. When connected to the dryer appliance 10, the body 402 is in fluid communication with the chamber 25 through the outlet opening 430 to provide the fluid received through one or more of the plurality of inlet openings 410.

The flow control device 400 includes a valve 440 positioned at the flowpath 420. In various embodiments, the vale 440 is a check valve, non-return valve, reflux valve, retention valve, foot valve, or, generally, a one-way valve, such as any appropriate valve configured to allow flow in a first direction (i.e., from the inlet opening 410 toward the outlet opening 430) and inhibit flow in an opposing second direction. In a particular embodiment, the one-way valve is a duckbill valve. The valve 440 forming a duckbill valve may include a flap 450. The flap 450 may particularly converge toward a centerline axis of the flowpath 420. When a fluid is pumped through the flowpath 420, the pressure causes the flap 450 to extend outward or diverge relative to the centerline axis, such as to open and allow flow of fluid therethrough. Below a pressure threshold, or cracking pressure, the flap 450 is closed or converged, such as to stop and inhibit flow across the valve 450. In certain embodiments, the flap 450 is formed from a silicone, silicone-based material, or other appropriate material for one-way valves.

The valve 440 may include a valve body or tube 448 insertable into the flowpath 420. The tube 448 extends within the flowpath 420 and includes the flap 450 at a distal end of the tube 448 relative to the inlet opening 410. A proximal end of the tube 448 opposite of the distal end may include a mating interface 452, such as a pipe thread or other appropriate interface, at which a supply conduit 412, 422 is attachable.

Figure 5B:
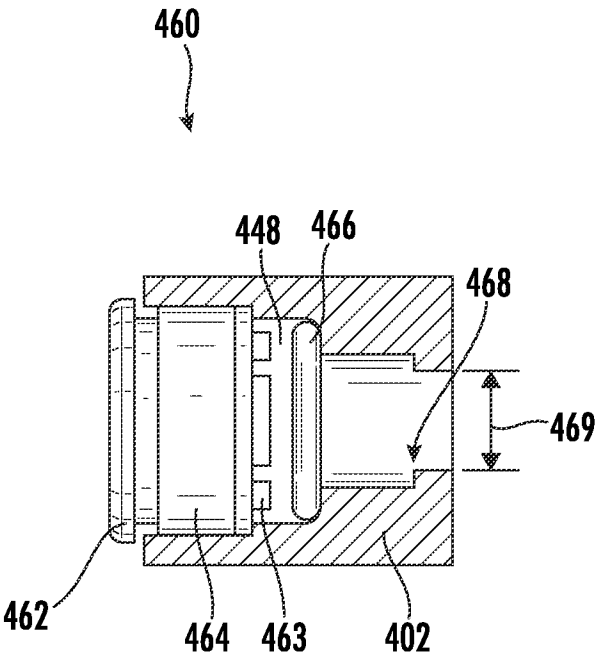
FIG. 5B provides a side view of components of a flow control device in accordance with exemplary embodiments of the present disclosure.
Figure 5A:
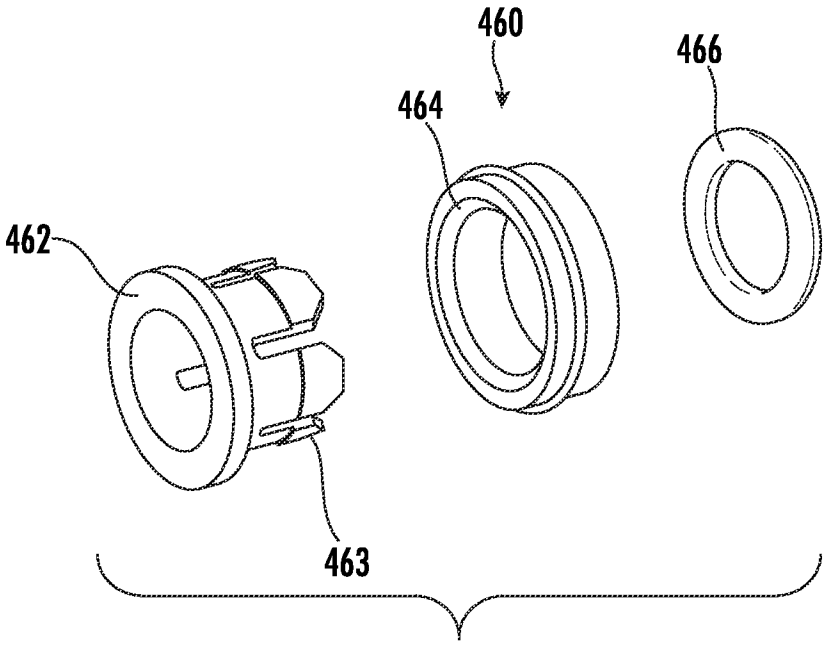
FIG. 5A provides an exploded perspective view of components of a flow control device in accordance with exemplary embodiments of the present disclosure.

Referring now to FIGS. 5A-5B, views of components of an exemplary flow control device 400 are provided. The flow control device may include a compression fitting 460 connectable at the tube 448 and the body 402. The compression fitting 460 is configured to couple the tube 448, or furthermore the valve 440, to the body 402. The compression fitting 460 includes a first ring 462 configured to releasably attach to a second ring 464. The second ring 464 is configured to attach around the first ring 462 at the tube 448. The first ring 462 may form a release ring of the compression fitting 460 and the second ring 464 may form a grasping ring of the compression fitting 460. In certain embodiments, the compression fitting 460 may furthermore include a seal 466, such as an O-ring. The body 402 may form a stepped surface 468 at which the tube 448 is inserted into the flowpath 420 formed by the body 402. A stop surface is formed by the stepped surface 468 at which further movement along the flowpath direction is prevented. The first ring 462 has teeth 463 configured to attach to the second ring 464. The second ring 464 may be formed to fit within the flowpath 420. A diameter 469 of the flowpath 420 at the distal end at which the valve 440 is extended is less than a diameter at the proximal end at which the second ring 464 is inserted. The tube 448 may be formed of any appropriate plastic for receiving high-temperature water or steam for a dryer appliance. Such materials may include, but are not limited to, nylon plastic or polyethylene plastic.

Figure 6:
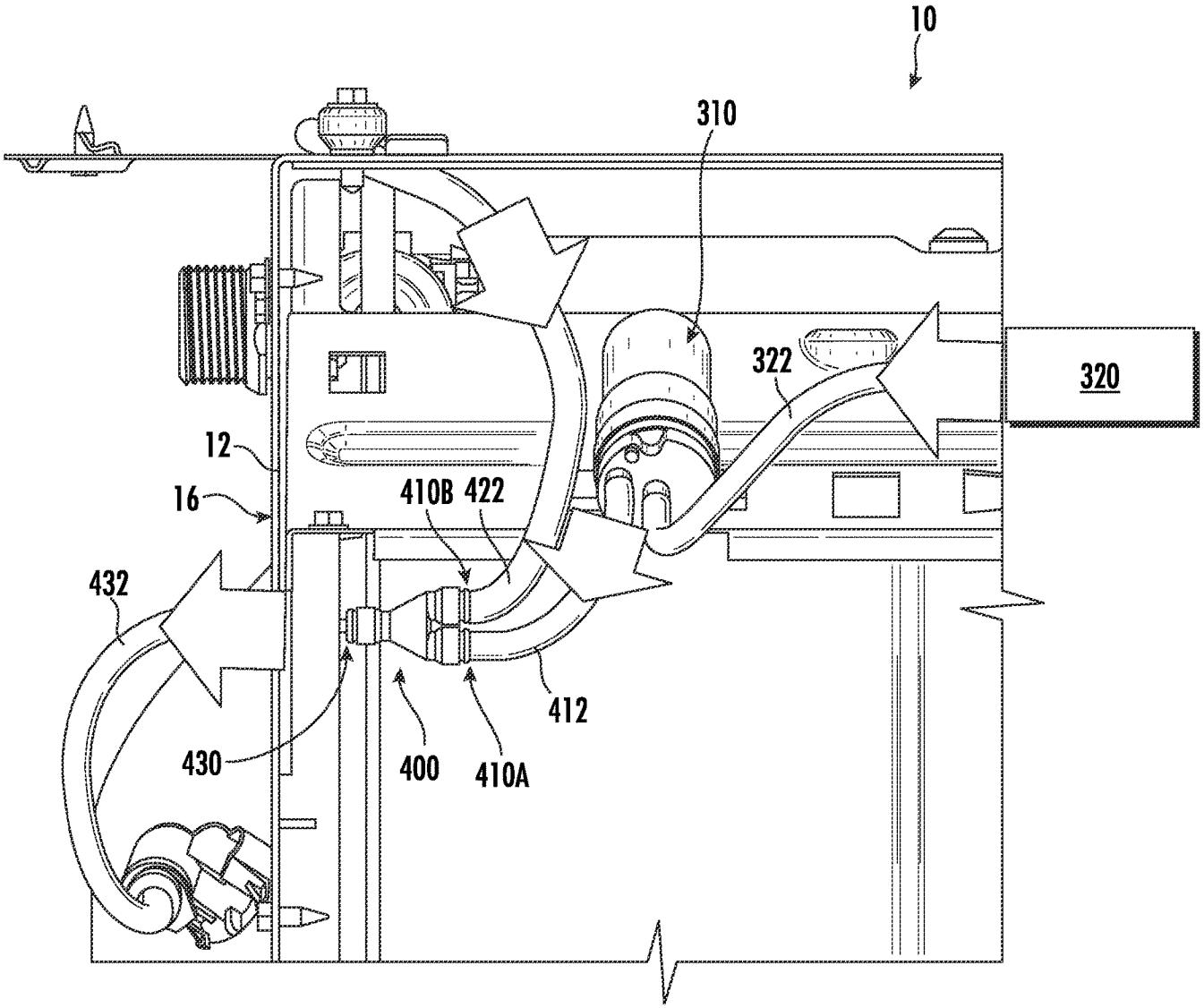
FIG. 6 provides a side view of a portion of the dryer appliance with portions of a cabinet of the dryer appliance removed to reveal certain components of the dryer appliance in accordance with exemplary embodiments of the present disclosure.
Figure 7:
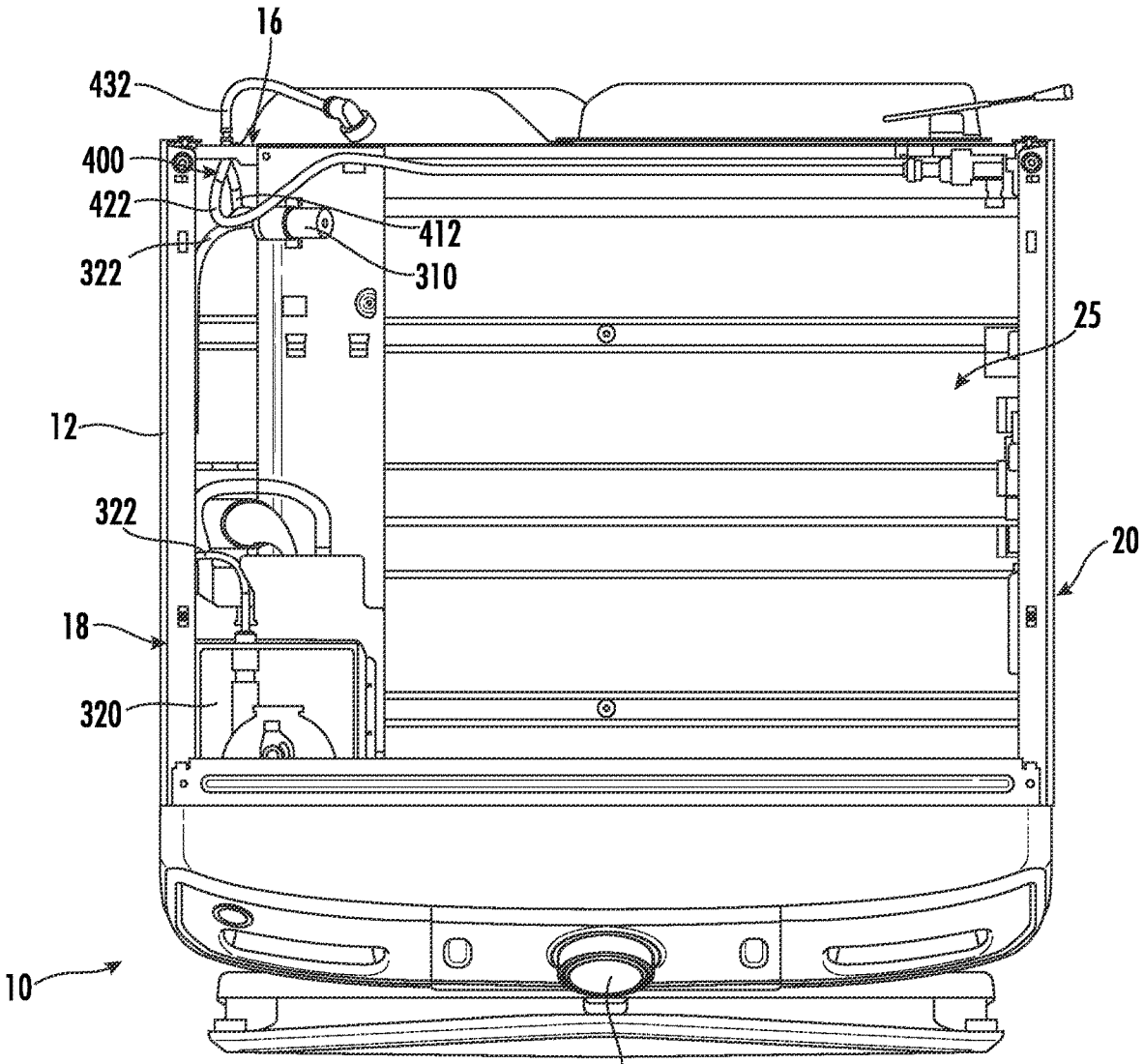
FIG. 7 provides a top-down view of a portion of the dryer appliance with portions of a cabinet of the dryer appliance removed to reveal certain components of the dryer appliance in accordance with exemplary embodiments of the present disclosure.

Referring now to the exemplary views provided in FIGS. 6-7, the dryer appliance 10 may include a first supply conduit 412 configured to provide a fluid solution from reservoir 320 to at least one of the plurality of inlet openings 410, such as a first inlet opening 410A. A second supply conduit 422 is configured to provide water or water vapor to at least one of another of the plurality of inlet openings 410, such as a second inlet opening 410B. An outlet conduit 432 is configured to provide the fluid, i.e., the fluid solution or the water or water vapor, through the outlet opening 430, such as to the chamber 25.

In various embodiments, the flow control device 400 is coupled to the cabinet 12. In an exemplary embodiment, the flow control device 400 is coupled to the rear panel 16 of the cabinet 12. However, in other embodiments, the flow control device 400 may extend through other panels, such as side panel 18, 20. In a particular embodiment, the flow control device 400 has a single outlet opening 430 and two or more inlet openings 410. The single outlet opening 4130 is extended through a respective single opening through the cabinet 12 and is extended in fluid communication from the outlet opening 430 to the chamber 25 through the outlet conduit 432. As such, a plurality of fluids is provided to the chamber 25 through a single flow control device 400 and outlet conduit 432, allowing for decreased cost and fewer interfaces in contrast to multiple valve bodies or multiple openings and conduits through the cabinet.

In an exemplary embodiment, the flow control device 400 includes the body 402 forming a first inlet opening 410A at a first inlet flowpath 420A and a second inlet opening 410B at a second inlet flowpath 420B. The first inlet flowpath 420A is in fluid communication with a first supply conduit 412 to receive a fluid solution from the post-dry system 300 and the second inlet flowpath 420B is in fluid communication with a second supply conduit 422 to receive water or water vapor. The body 402 forms an outlet flowpath 434 in fluid communication with the first inlet flowpath 420A and the second inlet flowpath 420B. The outlet conduit 432 provides fluid communication from the outlet flowpath 434 through the outlet opening 430. The valve 440 at the first inlet flowpath 420A and the second inlet flowpath 420B is configured to selectively provide fluid communication from the first inlet flowpath 410A and the second inlet flowpath 420B to the outlet flowpath 434. In particular embodiments, a plurality of valves 440 is provided at respective inlet flowpaths 420.

In certain embodiments, tube 448 is positioned at the inlet flowpaths 420A, 420B, and the tube 448 forms inlet flowpath 406 through which fluid travels through valve 440. Tube 428 may be positioned at outlet flowpath 430 similarly as described regarding tube 448. Compression fitting 460 (FIGS. 5A-5B) may be included at tubes 448, 428 such as described above. Conduits 412, 422, 432 are releasably attachable to respective tubes 448, 428 such as described above.

Certain embodiments of the flow control device 400 may particularly include a single outlet for a plurality of inlets. However, other embodiments of the flow control device 400 may include a plurality of outlets and a plurality of inlets.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance comprising:

a cabinet;

a drum rotatably mounted within the cabinet, the drum defining a chamber for receipt of articles for drying;

a flow control device comprising a unitary, monolithic, integral body forming a plurality of inlet openings, wherein the body forms a flowpath extending co-directional to a centerline axis from each of the inlet openings to a single outlet opening, the plurality of inlet openings each configured to receive a fluid, and wherein the body is in fluid communication with the chamber through the outlet opening to provide a fluid received through one or more of the plurality of inlet openings, and wherein the flow control device comprises a valve positioned at the flowpath, the valve comprising a tube insertable into the flowpath extending co-directional to the centerline axis, and wherein a compression fitting is connectable at the body and configured to couple the valve to the body, wherein the compression fitting comprises a first ring configured to releasably attach to the tube, the compression fitting comprising a second ring configured to releasably attach around the first ring and the tube, wherein the valve is connected to a distal end of the tube relative to the inlet opening.

2. The laundry appliance of claim 1, wherein the valve at the flow control device is a one-way valve.

3. The laundry appliance of claim 2, wherein the one-way valve is a duckbill valve.

4. The laundry appliance of claim 1, comprising:

a first supply conduit configured to provide a fluid solution to at least one of the plurality of inlet openings; and a second supply conduit configured to provide water or water vapor to at least one of another of the plurality of inlet openings.

5. The laundry appliance of claim 4, comprising:

an outlet conduit configured to provide the fluid to the chamber.

6. The laundry appliance of claim 4, comprising:

a reservoir positioned within the cabinet, the reservoir configured to store the fluid solution, the first supply conduit fluidly coupled to the reservoir to flow the fluid solution through one or more of the plurality of inlet openings through the outlet opening of the flow control device.

7. The laundry appliance of claim 1, the flow control device coupled to the cabinet.

8. The laundry appliance of claim 7, wherein the outlet opening is extended through a respective opening at the cabinet.

9. A dryer appliance comprising:

a cabinet;

a drum rotatably mounted within the cabinet, the drum defining a chamber for receipt of articles for drying;

a conditioning system in fluid communication with the chamber, the conditioning system configured to heat and remove moisture from air flowing therethrough;

a post-dry system comprising a reservoir containing a fluid solution;

a flow control device comprising a unitary, monolithic, integral body forming a first inlet opening at a first inlet flowpath extending co-directional to a centerline axis, wherein the first inlet flowpath is in fluid communication with a first supply conduit to receive water or water vapor through the first inlet opening, wherein the body forms a second inlet opening at a second inlet flowpath extending co-directional to the centerline axis, the second inlet flowpath in fluid communication with a second supply conduit to receive a fluid solution through the second inlet opening from the reservoir, wherein the body forms a single outlet flowpath extending co-directional to the centerline axis and in fluid communication with the first inlet flowpath and the second inlet flowpath, wherein an outlet conduit provides fluid communication with the outlet flowpath through an outlet opening formed at the outlet flowpath, and the flow control device comprising a valve at the first inlet flowpath and the second inlet flowpath, the valve comprising a tube extending co-directional to the centerline axis and insertable into each of the first inlet flowpath and the second inlet flow path, the valve configured to selectively provide fluid communication from the first inlet flowpath and the second inlet flowpath to the outlet flowpath, and wherein a compression fitting is connectable at the body and configured to couple the valve to the body, wherein the compression fitting comprises a first ring configured to releasably attach to the tube, the compression fitting comprising a second ring configured to releasably attach around the first ring and the tube, wherein the valve is connected to a distal end of the tube relative to the inlet opening.

10. The dryer appliance of claim 9, wherein the valve at the flow control device is a one-way valve.

11. The dryer appliance of claim 9, the post-dry system comprising:

a pump configured to selectively flow the fluid solution from the reservoir through the second supply conduit, the first inlet flowpath or the second inlet flowpath, and the outlet flowpath at the flow control device.

* * * * *